US005940518A

United States Patent [19]

Augustyn et al.

[11] Patent Number: 5,940,518

[45] Date of Patent: Aug. 17, 1999

[54] METHOD AND APPARATUS FOR INDICATING SPEAKER FAULTS

[75] Inventors: Michael Thomas Augustyn; Joseph Robert Dockemeyer, Jr., both of Kokomo; William E. Dyson, Carmel, all of Ind.; J. Alexander Easley, Warren, Mich.; Gary K. Mitchell, Kokomo, Ind.

[73] Assignee: Delco Electronics Corporation, Kokomo, Ind.

[21] Appl. No.: 08/943,214

[22] Filed: Oct. 6, 1997

[51] Int. Cl.[6] ..... H04R 29/00

[52] U.S. Cl. ..... 381/59; 381/86; 455/226.4

[58] Field of Search ..... 381/58, 59, 86, 381/55; 455/226.4

[56] References Cited

U.S. PATENT DOCUMENTS 5,361,305 11/1994 Easley et al. ..... 381/86

5,450,624 9/1995 Porambo et al. ..... 455/226.1

*Primary Examiner*—Ping Lee

*Attorney, Agent, or Firm*—Jimmy L. Funke

[57] ABSTRACT

In an automotive radio system an amplifier is capable of detecting speaker faults. A fault signal from the amplifier is received by a microprocessor which sends a fault message to a radio display and/or stores fault data which can be accessed via a serial data link by a diagnostic tool. One embodiment of the amplifier has an output pin for outputting distortion signal, and that pin is used when distortion is not likely to also output a fault signal which reveals the presence of a fault. Another embodiment of the amplifier has a data storage register which receives data on the type of fault and the affected channel, and a data bus to send the data to the microprocessor.

14 Claims, 3 Drawing Sheets

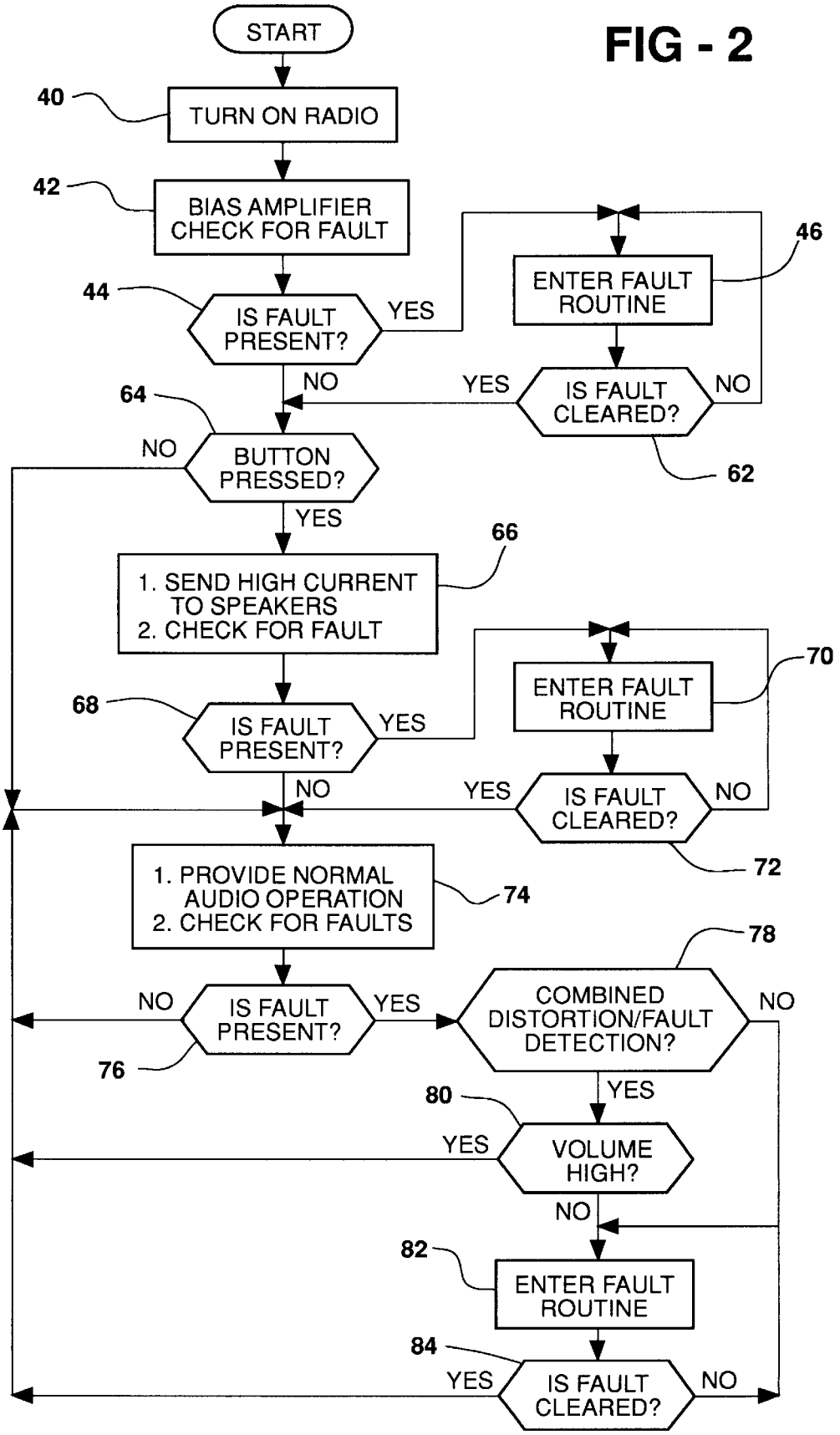
FIG - 2
START
40
TURN ON RADIO
42
BIAS AMPLIFIER CHECK FOR FAULT
44
IS FAULT PRESENT?
YES
NO
46
ENTER FAULT ROUTINE
IS FAULT CLEARED?
YES
NO
62
64
BUTTON PRESSED?
NO
YES
66
1. SEND HIGH CURRENT TO SPEAKERS
2. CHECK FOR FAULT
68
IS FAULT PRESENT?
YES
NO
70
ENTER FAULT ROUTINE
IS FAULT CLEARED?
YES
NO
72
1. PROVIDE NORMAL AUDIO OPERATION
2. CHECK FOR FAULTS
74
IS FAULT PRESENT?
NO
YES
76
78
COMBINED DISTORTION/FAULT DETECTION?
NO
YES
80
VOLUME HIGH?
YES
NO
82
ENTER FAULT ROUTINE
84
IS FAULT CLEARED?
YES
NO

METHOD AND APPARATUS FOR INDICATING SPEAKER FAULTS

FIELD OF THE INVENTION

This invention relates to the detection of speaker faults and particularly to detection and indication of speaker faults to a vehicle operator or to service personnel.

BACKGROUND OF THE INVENTION

In an automotive radio system, when a speaker fault occurs the radio or perhaps one channel shuts down, quits working, or is damaged. To prevent damage, many radios use audio amplifiers with built in protection which senses a speaker fault and shuts down at least the channel serving that speaker. Other radios lack that feature. In any event, the operator or service technician will not know the cause of the failure and will assume the problem is in the radio/amplifier, and replace that. Then the same problem will occur, and a search will be made for speaker faults or other system problems. It is desirable, then, that a speaker fault should be readily recognizable so that the service can be properly directed to correcting the problem.

SUMMARY OF THE INVENTION

It is therefore an object of the invention to detect speaker faults and indicate a fault to the operator or technician.

An audio amplifier with the capability to detect a speaker fault is configured to produce a signal when a fault occurs. A microprocessor responsive to such a fault signal sends a suitable message to the radio display to apprise the operator of the condition. Alternatively, the fault information is stored in memory associated with the microprocessor and is retrieved via a data bus by a diagnostic tool used by a service technician.

Fault detection begins when a radio is turned on. Then before an audio signal is applied, the amplifier is biased and a fault check is performed by the amplifier. At this stage, the fault detection feature can respond to a short to power or to ground and to an open load. If a fault is found the microprocessor executes a fault routine which effects an indication and/or stores fault data and limits the output of the radio from playing until the fault is repaired or otherwise cleared. If there is no fault or if a fault has been cleared, the operator may test for a shorted load by pressing designated radio buttons which cause a high current audio signal to be sent to the speakers. If a fault is detected then, the fault routine is entered but this time the radio is permitted to play at a reduced volume as long as the fault is present. Finally, if no fault is present, normal audio operation is provided and fault detection continues.

BRIEF DESCRIPTION OF THE DRAWINGS

The above and other advantages of the invention will become more apparent from the following description taken in conjunction with the accompanying drawings wherein like references refer to like parts and wherein:

FIGS. 2 and 3 are flow charts illustrating the method of the invention.

DESCRIPTION OF THE INVENTION

The ensuing description refers to an automotive radio. That term is used herein to include an audio source which may be, for example, a cassette player or other source as well as a tuner.

Figure 1:
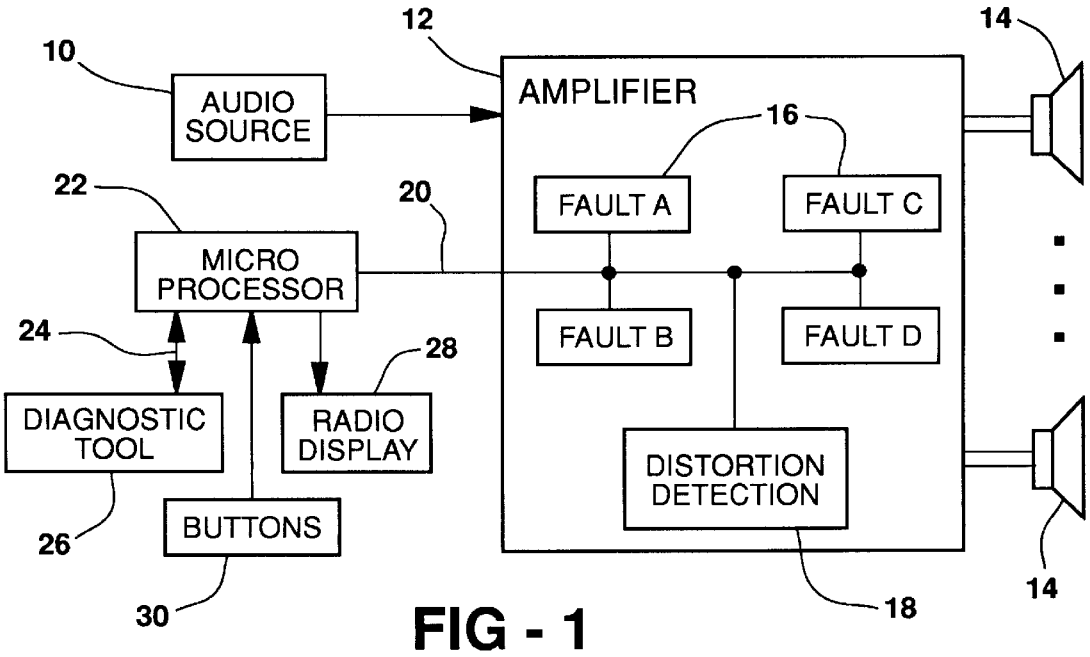
FIG. 1 is a block diagram of radio hardware including an audio amplifier for speaker fault detection according to one embodiment the invention.

Referring to FIG. 1, a radio includes an audio source 10 providing a signal to an audio amplifier 12 which, in this example, has four output channels, each supplying at least one speaker 14. The amplifier is of the type which has built-in circuits 16 for detecting speaker faults in each channel and includes means for disabling any channel exhibiting a fault. The amplifier 12 also includes a distortion detection circuit 18 which is coupled to an output line 20 to impose a signal on the line when distortion is present. As thus far described, the amplifier is well known for use in automotive radios where the speaker fault and protection capability is desired. It is available from SGS Thomson Microelectronics, of Milan, Italy, as a bridge audio amplifier part no. QBA TDA7385. Similar devices serving only one or two channels are also available from the same source. Here it is proposed to configure the device to couple fault signals from the fault detection circuits 16 to the line 20, so that by monitoring the line when distortion is not likely to occur the state of the line will indicate the presence of a fault.

A microprocessor 22 is coupled to the line 20 to monitor its state and to discriminate between distortion and speaker fault signals. The microprocessor is connected to a serial data bus 24 to supply a fault signal or stored fault data to a normal dealership diagnostic tool 26 which is not part of the radio but is an instrument to be applied by a service technician. The radio has a display 28 which is coupled to the microprocessor 22 to display a speaker fault message as well as station identification and other information. Depending on the display capability, the fault message may be, for example, "SPKR PRB", or an error code such as "ERR3". Buttons 30 or other normal radio controls provide inputs to the microprocessor 22.

Figure 3:
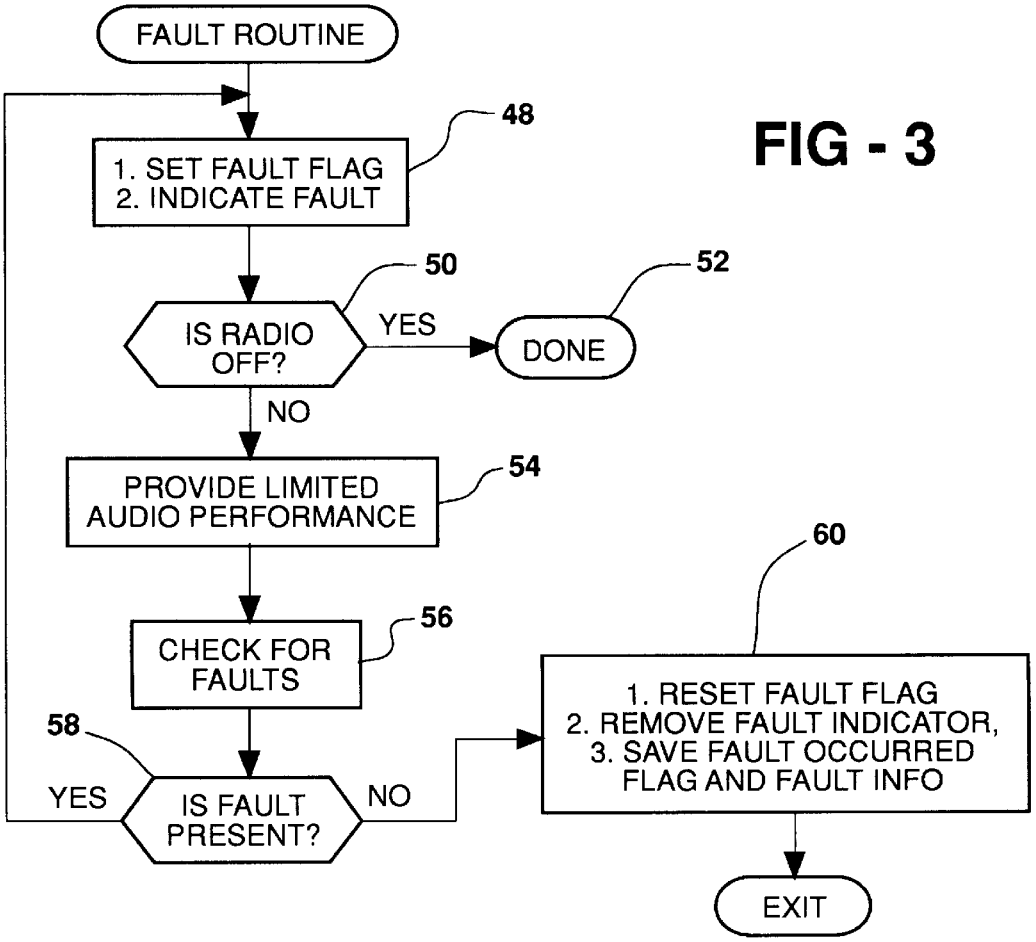

The method of detecting and indicating speaker faults is illustrated by the flow charts of FIGS. 2 and 3 wherein the functional description of each block in the charts is accompanied by a number in angle brackets <nn> which corresponds to the reference number of the block. The method involves manual inputs, operation by the amplifier 12 and the fault circuits 16, and operations performed by the microprocessor 22. Each time the radio is first turned on <40> a DC bias is applied to each channel of the amplifier and the fault circuits 16 check for faults <42>. At this time no audio signal is applied and faults due to open load, shorts to ground or shorts to power will be revealed. If a fault is present <44>, a fault circuit changes the state of line 20 and a fault routine is entered <46>. The fault routine <46> is detailed in FIG. 3. The microprocessor responds to the state of line 20 by setting a fault flag and indicating a fault <48> by sending a message to the radio display and storing the fault flag for future examination by the diagnostic tool 26. If the radio is turned off while the fault routine is being executed <50> the fault detection will end <52>. If the radio remains on, a limited audio performance may be allowed <54> but it is preferred to keep the sound off during this initial fault test; however for later tests the limited audio (low volume) is permitted. Next another fault check is made <56> so that if the fault remains <58> the fault routine continues until the radio is turned off. Whenever the fault is cleared either due to a repair or due to an intermittent condition, the fault flag is reset, the fault indication is removed, and a fault occurred flag and fault information will be stored <60>.

Then when the fault is cleared <62> (returning to FIG. 2) the operator has the option of testing for internal speaker shorts. This test requires operator action and results in a loud unpleasant sound and will not be performed except when the operator or technician suspects there is a speaker fault. The operator action is, for example, the pressing of two buttons simultaneously, say the #1 and #4 preset buttons. If the buttons are pressed <64> an audio signal is sent to the speakers and a fault check is performed <66>. The signal has high current but is insufficient to cause distortion. This fault check is able to detect a shorted load. If a fault is present <68> the fault routine is entered <70>. This is the same routine (FIG. 3) used above and this time low volume audio performance is permitted. If the fault is cleared <72> or if the button had not been pressed <64> normal audio operation is provided and fault checking continues <74>. If a fault is present <76> it is determined whether the fault detection and distortion detection share the same line 20 as in FIG. 1 <78>. This is done because the same method can be used with other amplifier arrangements. A flag could be set to identify a combined detection arrangement when the software is installed, and the flag is read to answer the inquiry <78>. If the combined detection configuration is used, and the volume setting is high <80>, it is assumed that the fault signal is the result of distortion and normal operation continues. If the volume setting is not high <80> the fault routine is entered <82>. This is the same routine (FIG. 3) used above and this time low volume audio performance is permitted. During the fault routine limited audio performance is allowed and if the fault is cleared <84> the normal operation is restored.

Figure 4:
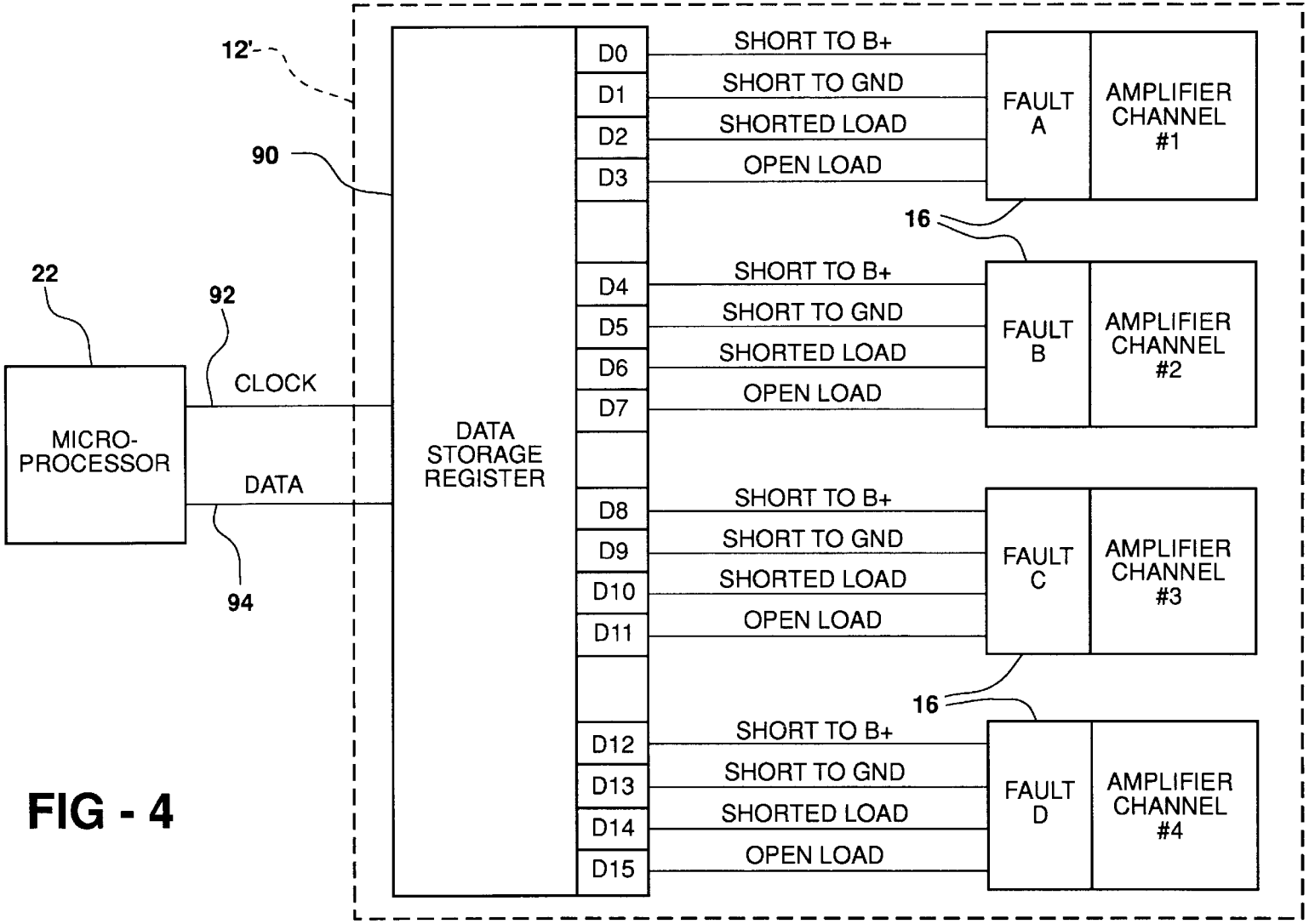
FIG. 4 is a block diagram of an audio amplifier for speaker fault detection according to another embodiment of the invention.

The fault circuits 16 of the amplifier are able to identify for each channel the specific type of fault; however there is no convenient way to extract that information for diagnostic purposes. The amplifier may be modified to include communication capability to output the detailed fault information. As shown in FIG. 4, a modified amplifier 12' includes a data storage register 90, and a clock bus 92 and a data bus 94 connect the register to the microprocessor 22. The fault circuits 16 for the several amplifiers channels each have four outputs for coupling specific fault data to pre-assigned bits D0 to D15 of the register 90. The fault outputs are short to B+ (power), short to ground, shorted load and open load. Whenever a fault check is made, the register data is clocked onto the data bus and read by the microprocessor to determine specific fault information and to provide appropriate indication. This data is independent of the distortion signal, although this communication capability can include distortion data if desired.

In operation of the system as modified by the FIG. 4 communication capability, the method of FIGS. 2 and 3 remains the same except that the high current used in step <66> does not have to be limited to a non-distorting level, and the steps <78> and <80> are omitted. Since more specific fault information is available, specific diagnosis may be accomplished by the diagnostic tool 26 as it accesses the information. Depending on the extent of the radio display 28, specific information may be shown there as well.

It will thus be seen that the detection of speaker faults according to the invention simplifies the diagnosis of radio problems and if there is a speaker fault, avoids the time and expense of unnecessary removal and testing of radios, which is usually the first step in analyzing such problems. Moreover, when the modified amplifier is used, the problem is narrowed to a particular fault in a specific channel, thereby greatly facilitating repair. In addition customer satisfaction is improved by detecting and repairing speaker faults in new vehicles at the factory or at the dealership before delivery to the customer.

The embodiments of the invention in which an exclusive property or privilege is claimed are defined as follows:

1. In a vehicle radio having amplifiers for driving speakers and manually operated means, apparatus for indicating speaker faults including open circuits and shorts to power or ground comprising:

means for triggering a high current audio signal to the speakers in response to the manually operated means;

means associated with the amplifiers for detecting speaker faults and for issuing a fault signal when a fault is detected;

a microprocessor in the radio connected to the means for detecting speaker faults and programmed to indicate a fault when a fault signal is issued, to provide low volume audio signals to the speakers as long as the fault condition exists, and to permit operation at a normal volume if the fault is cleared; and means for communicating a fault indication to service personnel.

2. Apparatus as defined in claim 1 wherein:

the microprocessor issues a fault message when a fault signal is issued; and the means for communication comprises a radio display for displaying a speaker fault message.

3. Apparatus as defined in claim 1 wherein:

the means for communicating comprises a data bus for communicating with service instrumentation; and the microprocessor is connected to the data bus, whereby the fault indication is supplied over the data bus to the instrumentation.

4. Apparatus as defined in claim 1 wherein:

the microprocessor is further programmed to repeatedly check for a fault signal after a fault has been detected, and to determine whether the fault is still present and to provide normal audio operation if the fault is not present.

5. Apparatus as defined in claim 4 wherein:

the microprocessor is further programmed to continue responding to fault signals during normal audio operation.

6. Apparatus as defined in claim 1 wherein:

the microprocessor is programmed to bias the amplifier without applying an audio signal when the radio is first turned on whereby open circuits and shorts to power or ground will be detected, and prevent application of an audio signal so long as a fault is detected.

7. Apparatus as defined in claim 1 wherein the means for detecting speaker faults includes:

means for determining the specific type of fault and which of several channels contains the fault; and digital communication means for supplying fault data to the microprocessor.

8. In a vehicle radio having amplifier means for driving speakers and apparatus for detecting distortion and speaker faults, a method for indicating speaker faults including shorts to power or ground and open circuits comprising the steps of:

turning on the radio;

testing for speaker faults in stages wherein in an initial stage when the radio is just turned on the amplifier means is biased, and then in a later stage normal radio operation is commenced;

checking for a fault in each stage; and when a fault is detected during normal audio operation, determining that there is no fault if the volume is at a high setting, and when it is determined that there is a fault setting a fault flag and indicating a fault.

9. The method as defined in claim 8 wherein if a fault is detected and the radio remains on:

checking again for faults and if no fault is then detected, resetting the fault flag, and saving fault information.

10. The method as defined in claim 8 wherein in an another stage testing comprises manually triggering a high current audio signal and checking for faults, whereby internal shorts of speakers are detected.

11. The method as defined in claim 8 wherein in an another stage testing comprises manually triggering a high current audio signal insufficient to cause dynamic distortion, and checking for faults, whereby internal shorts of speakers are detected.

12. In a vehicle radio having amplifier means for driving speakers and apparatus for detecting speaker faults, a method for indicating speaker faults including shorts to power or ground and open circuits comprising the steps of:

1) biasing each amplifier by turning on the radio;

2) checking for a fault;

3) if a fault is present, setting a fault flag and indicating a fault;

4) again checking for a fault if the radio remains on, 4a) then if a fault is present, setting a fault flag and indicating a fault, 4b) if a fault is not present resetting the fault flag, stop indicating a fault and saving fault information;

5) sending a high current audio signal from the amplifier means to the speakers;

6) repeating steps 2–4b, 6a) if there is a fault detected in step 4, providing limited audio performance; and 6b) if there is no fault detected in step 2 or 4, providing normal audio operation.

13. The method as defined in claim 12 comprising the further steps of:

during normal radio operation repeating steps 2–4b of claim 14, if there is a fault detected in step 4, providing limited audio performance; and if there is no fault detected in step 2 or 4, continuing normal audio operation.

14. The method as defined in claim 13 wherein if a fault is detected due to distortion and volume control is at a high setting, continuing normal radio operation.

* * * * *